US007353950B2

(12) United States Patent
Stahl

(10) Patent No.: US 7,353,950 B2
(45) Date of Patent: Apr. 8, 2008

(54) CONTAINER

(75) Inventor: Edward Stahl, Tyler, TX (US)

(73) Assignee: Norseman Plastics, Ltd., Rexdale, Ontario (CA)

( * ) Notice: Subject to any disclaimer, the term of this patent is extended or adjusted under 35 U.S.C. 154(b) by 0 days.

(21) Appl. No.: 11/005,920

(22) Filed: Dec. 6, 2004

(65) Prior Publication Data

US 2006/0118450 A1 Jun. 8, 2006

(51) Int. Cl.

| | |
|---|---|
| ***B65D 21/032*** | (2006.01) |
| ***B65D 21/06*** | (2006.01) |
| ***B65D 25/32*** | (2006.01) |
| *B65D 6/28* | (2006.01) |
| *B65D 88/00* | (2006.01) |

(52) U.S. Cl. ..... 206/506; 206/518; 220/1.5; 220/669; 220/676; 220/760

(58) Field of Classification Search ..... 206/506, 206/509, 557, 518; 220/1.5, 669, 676, 760
See application file for complete search history.

(56) References Cited

U.S. PATENT DOCUMENTS

| | | | |
|---|---|---|---|
| 2,026,204 | A | 12/1935 | Andrews |
| 2,029,746 | A | 2/1936 | Tufts et al. |
| 2,061,414 | A | 11/1936 | Tufts et al. |
| 2,134,875 | A | 11/1938 | Henze |
| 2,609,120 | A | 9/1952 | Williams |
| 2,641,383 | A | 6/1953 | Coursey |
| 3,220,603 | A | 11/1965 | Bromley |
| 3,323,673 | A | 6/1967 | Cowan |
| 3,375,953 | A | 4/1968 | Miller, Jr. |
| 3,379,339 | A | 4/1968 | Asenbauer |
| 3,420,402 | A | 1/1969 | Frater et al. |

(Continued)

FOREIGN PATENT DOCUMENTS

| | | |
|---|---|---|
| CA | 892971 | 2/1972 |

(Continued)

OTHER PUBLICATIONS

Canadian Office Action issued in Candian Patent Application No. 2,367,649 (Feb. 20, 2006).

(Continued)

*Primary Examiner*—Anthony D. Stashick
*Assistant Examiner*—Niki M. Eloshway
(74) *Attorney, Agent, or Firm*—Katten Muchin Rosenman LLP; Mark W. Hrozenchik; Richard P. Bauer

(57) ABSTRACT

A nestable container has a bottom and four peripheral walls extending upwardly from said bottom. At least a portion of the four peripheral walls extends outwardly from the container bottom such that the angle between said container bottom and said portion of said opposing side and end walls is obtuse. The four peripheral walls may include interior projections positioned substantially at a right angle to said bottom. Said container may further include a pair of bails and external projections positioned along said exterior surface of at least one of said peripheral walls. Said external projections may be positioned slightly inward of said interior projections, so that at least a portion of said external projections aligns with said interior projections when said container is stacked on said bails of an identical container.

14 Claims, 10 Drawing Sheets

U.S. PATENT DOCUMENTS

| | | | | | |
|---|---|---|---|---|---|
| 3,421,656 | A | | 1/1969 | Asenbauer | |
| 3,659,743 | A | | 5/1972 | Box | |
| 3,752,352 | A | | 8/1973 | Senecal | |
| 3,780,905 | A | | 12/1973 | Heroizer | |
| 3,907,111 | A | | 9/1975 | Levenhagen | |
| 3,951,265 | A | | 4/1976 | Carroll | |
| 3,952,903 | A | | 4/1976 | Sanders et al. | |
| 3,993,211 | A | | 11/1976 | Astle | |
| 4,000,817 | A | | 1/1977 | Sanders et al. | |
| 4,105,117 | A | | 8/1978 | Atkin et al. | |
| 4,106,623 | A | | 8/1978 | Carroll et al. | |
| 4,109,791 | A | | 8/1978 | Clipson et al. | |
| 4,194,626 | A | | 3/1980 | Boller | |
| D258,050 | S | | 1/1981 | Cornou | |
| 4,247,004 | A | * | 1/1981 | Bird | 206/506 |
| 4,391,369 | A | * | 7/1983 | Stahl et al. | 206/506 |
| 4,423,813 | A | | 1/1984 | Kreeger et al. | |
| 4,426,001 | A | | 1/1984 | Stahl et al. | |
| 4,440,302 | A | * | 4/1984 | Ehrman et al. | 206/506 |
| 4,466,541 | A | | 8/1984 | Tabler et al. | |
| 4,573,577 | A | | 3/1986 | Miller | |
| 4,601,393 | A | | 7/1986 | Veenman et al. | |
| RE32,223 | E | * | 8/1986 | Kreeger et al. | 206/506 |
| 4,619,371 | A | | 10/1986 | Rehrig | |
| 4,643,310 | A | * | 2/1987 | Deaton et al. | 206/506 |
| 4,671,411 | A | | 6/1987 | Rehrig et al. | |
| D292,634 | S | | 11/1987 | Chabot | |
| 4,759,451 | A | | 7/1988 | Apps | |
| 4,848,578 | A | * | 7/1989 | Schafer | 206/506 |
| 4,863,062 | A | | 9/1989 | Holliday | |
| 4,905,833 | A | | 3/1990 | Kreeger et al. | |
| 4,947,992 | A | | 8/1990 | Schafer | |
| 4,982,844 | A | * | 1/1991 | Madan et al. | 206/506 |
| D320,298 | S | | 9/1991 | Apps et al. | |
| 5,083,666 | A | | 1/1992 | Lam | |
| D343,042 | S | | 1/1994 | Apps et al. | |
| D344,387 | S | | 2/1994 | Holliday | |
| 5,287,966 | A | | 2/1994 | Stahl | |
| D348,138 | S | | 6/1994 | Lang-Ree et al. | |
| D348,343 | S | | 6/1994 | Lang-Ree et al. | |
| D350,028 | S | | 8/1994 | Apps | |
| D350,437 | S | | 9/1994 | Apps et al. | |
| 5,344,021 | A | | 9/1994 | Rose | |
| 5,344,022 | A | | 9/1994 | Stahl | |
| D354,167 | S | | 1/1995 | Stahl | |
| 5,377,858 | A | * | 1/1995 | Morris, Sr. | 220/254.8 |
| 5,392,915 | A | | 2/1995 | Kalin | |
| 5,415,293 | A | | 5/1995 | Ackermann et al. | |
| 5,494,163 | A | | 2/1996 | Apps | |
| D374,555 | S | | 10/1996 | McMath | |
| 5,609,254 | A | | 3/1997 | Loftus et al. | |
| 5,617,953 | A | | 4/1997 | Cope | |
| D379,718 | S | | 6/1997 | Raghunathan | |
| D381,203 | S | | 7/1997 | Ackermann et al. | |
| D382,404 | S | | 8/1997 | Cope | |
| 5,735,431 | A | | 4/1998 | LeTrudet | |
| 5,752,602 | A | | 5/1998 | Ackermann et al. | |
| 5,769,230 | A | | 6/1998 | Koefelda | |
| 5,772,033 | A | | 6/1998 | Loftus et al. | |
| D398,448 | S | | 9/1998 | Zanni | |
| D401,412 | S | | 11/1998 | LeTrudet | |
| 5,860,527 | A | | 1/1999 | Frankenberg et al. | |
| 5,881,902 | A | | 3/1999 | Ackermann | |
| 5,896,987 | A | | 4/1999 | Bettenhausen | |
| 5,924,572 | A | | 7/1999 | Cope | |
| 5,975,324 | A | | 11/1999 | Schmitt | |
| D420,219 | S | | 2/2000 | Elvin-Jensen et al. | |
| 6,036,049 | A | | 3/2000 | Hwang | |
| D423,217 | S | | 4/2000 | Varfeldt | |
| 6,059,114 | A | | 5/2000 | Loftus | |
| 6,089,373 | A | | 7/2000 | Cope | |
| D429,565 | S | | 8/2000 | Aiken | |
| 6,138,863 | A | | 10/2000 | Aiken | |
| D436,729 | S | | 1/2001 | Aiken | |
| 6,179,156 | B1 | | 1/2001 | Aiken | |
| 6,250,490 | B1 | | 6/2001 | Loftus | |
| 6,260,706 | B1 | | 7/2001 | Koefelda | |
| D446,017 | S | | 8/2001 | Koefelda | |
| D446,392 | S | | 8/2001 | Overholt et al. | |
| 6,293,418 | B1 | | 9/2001 | Ogden et al. | |
| 6,308,858 | B1 | | 10/2001 | Koefelda | |
| D452,614 | S | | 1/2002 | Overholt | |
| 6,338,181 | B1 | | 1/2002 | Hwang | |
| 6,386,388 | B1 | | 5/2002 | Overholt | |
| D458,753 | S | | 6/2002 | Overholt et al. | |
| 6,398,054 | B1 | | 6/2002 | Overholt et al. | |
| 6,405,888 | B1 | | 6/2002 | Overholt et al. | |
| 6,409,041 | B1 | | 6/2002 | Overholt et al. | |
| D460,619 | S | | 7/2002 | Koefelda | |
| D462,522 | S | | 9/2002 | Apps et al. | |
| 6,460,717 | B1 | | 10/2002 | Smyers et al. | |
| D478,421 | S | | 8/2003 | Overholt et al. | |
| 6,601,724 | B1 | | 8/2003 | Koefelda et al. | |
| 6,607,199 | B2 | | 8/2003 | Gruber | |
| 6,631,822 | B1 | | 10/2003 | Overholt | |
| D487,634 | S | | 3/2004 | Apps et al. | |
| 6,811,125 | B1 | | 11/2004 | Koefelda et al. | |
| 6,843,386 | B2 | | 1/2005 | Raghunathan et al. | |
| 6,863,180 | B2 | | 3/2005 | Apps et al. | |
| 6,880,705 | B2 | | 4/2005 | Ötting et al. | |
| 6,899,242 | B2 | | 5/2005 | Overholt et al. | |
| 6,918,502 | B1 | | 7/2005 | Overholt et al. | |
| 6,918,508 | B2 | | 7/2005 | Hwang | |
| 6,938,772 | B2 | | 9/2005 | Aiken et al. | |
| 7,014,043 | B2 | | 3/2006 | Raghunathan et al. | |
| 7,017,745 | B2 | * | 3/2006 | Raghunathan | 206/506 |
| 7,017,766 | B2 | | 3/2006 | Hsu et al. | |
| 7,044,319 | B2 | | 5/2006 | Overholt et al. | |
| 7,048,134 | B1 | | 5/2006 | Hagan | |
| 7,048,135 | B2 | | 5/2006 | Smyers et al. | |
| 7,059,489 | B2 | | 6/2006 | Apps et al. | |
| 7,063,210 | B2 | | 6/2006 | Smyers et al. | |
| 7,086,555 | B2 | | 8/2006 | Overholt et al. | |
| 7,100,786 | B2 | | 9/2006 | Smyers | |
| 7,104,414 | B2 | | 9/2006 | Apps et al. | |
| 7,128,231 | B2 | | 10/2006 | Overholt | |
| 2001/0019063 | A1 | | 9/2001 | Apps | |
| 2002/0056717 | A1 | | 5/2002 | Hwang | |
| 2002/0148842 | A1 | | 10/2002 | Overholt et al. | |
| 2002/0158067 | A1 | | 10/2002 | Overholt et al. | |
| 2002/0179480 | A1 | | 12/2002 | Raghunathan et al. | |
| 2003/0024845 | A1 | | 2/2003 | Smyers et al. | |
| 2003/0042255 | A1 | | 3/2003 | Smyers et al. | |
| 2003/0070957 | A1 | | 4/2003 | Apps et al. | |
| 2003/0116564 | A1 | | 6/2003 | Overholt et al. | |
| 2003/0132228 | A1 | | 7/2003 | Apps et al. | |
| 2003/0230510 | A1 | | 12/2003 | Aiken et al. | |
| 2004/0020821 | A1 | | 2/2004 | Koelfelda et al. | |
| 2004/0069780 | A1 | | 4/2004 | Apps et al. | |
| 2004/0099662 | A1 | | 5/2004 | Overholt | |
| 2004/0155048 | A1 | | 8/2004 | Aiken | |
| 2004/0178197 | A1 | | 9/2004 | Hsu et al. | |
| 2004/0182858 | A1 | | 9/2004 | Smyers | |
| 2004/0195139 | A1 | | 10/2004 | Wong | |
| 2004/0226945 | A1 | | 11/2004 | Hsu et al. | |
| 2004/0245142 | A1 | | 12/2004 | Raghunathan | |
| 2005/0040069 | A1 | | 2/2005 | Apps et al. | |
| 2005/0224385 | A1 | | 10/2005 | Hassell et al. | |
| 2005/0263423 | A1 | | 12/2005 | Hassell et al. | |
| 2005/0263424 | A1 | | 12/2005 | Hassell et al. | |
| 2006/0065567 | A1 | | 3/2006 | Hassell et al. | |
| 2006/0096883 | A1 | | 5/2006 | Raghunathan et al. | |
| 2006/0196800 | A1 | | 9/2006 | Baltz | |

2006/0231449 A1 10/2006 Hassell et al.

FOREIGN PATENT DOCUMENTS

| | | | |
|---|---|---|---|
| CA | 2002417 | | 5/1990 |
| CA | 1273881 | | 9/1990 |
| CA | 2129617 | C | 2/1995 |
| CA | 2130973 | | 3/1995 |
| CA | 2130973 | A1 | 3/1995 |
| CA | 2212239 | C | 8/1996 |
| CA | 2313137 | A1 | 7/1999 |
| CA | 2296895 | | 7/2000 |
| CA | 2296895 | A1 | 7/2000 |
| CA | 2387491 | | 3/2001 |
| CA | 2326118 | A1 | 5/2001 |
| CA | 2387491 | | 5/2001 |
| CA | 2392265 | A1 | 6/2001 |
| CA | 2395367 | A1 | 7/2001 |
| CA | 2397522 | | 8/2001 |
| CA | 2406099 | | 10/2001 |
| CA | 2384941 | | 1/2002 |
| CA | 2421595 | | 3/2002 |
| CA | 2421595 | A1 | 3/2002 |
| CA | 2426949 | | 5/2002 |
| CA | 2367649 | A1 | 7/2002 |
| CA | 2455355 | A1 | 2/2003 |
| CA | 2472360 | | 7/2003 |
| CA | 2472360 | A1 | 7/2003 |
| CA | 2475531 | A1 | 9/2003 |
| CA | 2485544 | | 12/2003 |
| CA | 2431444 | A1 | 12/2004 |
| DE | 3511321 | A1 | 10/1986 |
| DE | 35218944 | A1 | 1/1987 |
| DE | 19939019 | A1 | 2/2001 |
| DE | 20002537 | U1 | 7/2001 |
| EP | 0 370 771 | A2 | 5/1990 |
| EP | 0368713 | A1 | 5/1990 |
| EP | 0557002 | A1 | 8/1993 |
| EP | 0697341 | A1 | 2/1996 |
| EP | 0926073 | A1 | 6/1999 |
| EP | 0953509 | | 11/1999 |
| EP | 0953509 | A1 | 11/1999 |
| FR | 1131652 | | 2/1957 |
| FR | 2678585 | A1 | 1/1993 |
| GB | 2 067 167 | A | 7/1981 |
| GB | 2124588 | A | 2/1984 |
| GB | 2129401 | A | 5/1984 |
| GB | 2209737 | A | 5/1989 |
| GB | 2296009 | A | 6/1996 |
| GB | 2333285 | A | 7/1999 |
| GB | 2350350 | A | 11/2000 |
| GB | 2373239 | A | 9/2002 |
| GB | 2373240 | A | 9/2002 |
| GB | 2374859 | B | 6/2004 |
| NL | 7905105 | | 6/1979 |
| TW | R.O.C. 338405 | | 8/1998 |
| TW | R.O.C. 372539 | | 10/1999 |
| WO | 9801352 | | 1/1998 |
| WO | 0027716 | A1 | 5/2000 |
| WO | 0051900 | A1 | 9/2000 |
| WO | 0066440 | A1 | 11/2000 |
| WO | 2006062899 | A2 | 6/2006 |

OTHER PUBLICATIONS

Canadian Office Action issued in Canadian Patent Application No. 2,431,444 (Dec. 12, 2005).

Canadian Office Action dated Feb. 20, 2006, issued in Canadian Application No. 2,367,649.

* cited by examiner

CONTAINER

TECHNICAL FIELD

This application relates to containers which are nestable and stackable with one another and, more particularly, to nestable and stackable containers used in storing and transporting meat or produce.

BACKGROUND OF THE INVENTION

Plastic rectangular containers which are open at the top have various industrial, commercial, and domestic applications. Such bins have four sides and a bottom, and often have handles positioned near the top of two opposing sides to facilitate carrying. Typically the four sides are angled outward, enabling an empty container to nest inside another empty container. This saves space in storing and transporting empty containers. However, this configuration, whereby the four sides are outwardly angled to enable nesting, may allow the contents of the container, particularly produce, to slip or shift in position when the containers are moved or transported. Containers with sides perpendicular to the container bottom limit slipping and/or shifting but require more space to store than do crates with sides that are angled outward. Collapsible containers require less storage space and may have perpendicular sides that limit slippage but are costly and require substantial time to assemble and disassemble. Moreover, collapsible containers typically have intricate parts that make cleaning difficult and thus allow the growth of bacteria over time, a particularly undesirable characteristic in crates typically used to transport produce.

Bails are typically used in pairs and are positioned along opposing sides of a storage container. Such bails are typically adapted to shift between an outward position flush with the sides and a position inward of the sides. In their inward position, the bails support the bottom of an upper container in a stacking position on top of a lower container. This prevents the contents of the lower container from being damaged when one container is stacked on top of another container. In their outward position, the bails are flush with the sides, allowing an empty container to nest inside another empty container. This saves space in storing and transporting empty containers. Typically bails shift from inward position to outward position by pivoting within an arced or circular opening. Such an opening may not firmly fix bails in position and may allow bail movement in a direction normal to the length of the bail.

When multiple nestable containers are stacked on top of each other using bails, the stack may become unstable. Because the sides of nestable containers are outwardly angled, the footprint of the container bottom is smaller than is the footprint of the top of the crate. The bails, which are positioned along the top of the crate, are wider than is the portion of the container bottom which rests on the bails. As a result, an upper-stacked container can slide along the bails of a lower stacked crate. If multiple upper-stacked crates are free to slide to a non-centered position, a stack of crates may become unstable.

SUMMARY OF INVENTION

One aspect of the present invention is a nestable container comprising a bottom, four peripheral walls extending upwardly from said bottom, the four peripheral walls including a pair of opposing side walls and a pair of opposing end walls, each of the opposing side and end walls including exterior surface an interior surface, at least a portion of said opposing side and end walls extending outwardly from said container bottom such that the angle between said container bottom and said portion of said opposing side and end walls is obtuse, interior projections positioned along the interior surface of at least one of said pair of opposing side walls or said pair of opposing end walls, the interior projections having an interior surface, said interior surface of said interior projections positioned substantially at a right angle to said bottom.

Another aspect of the present invention is a nestable container comprising, a bottom, four peripheral walls extending upwardly from the bottom, the four peripheral walls including a pair of opposing side walls and a pair of opposing end walls, each of the opposing side and end walls including an exterior surface and an interior surface, at least a portion of the opposing side and end walls extending outwardly from the container bottom such that the angle between the container bottom and the portion of the opposing side and end walls is obtuse, four vertical slots, two of the vertical slots positioned within each of the pair of opposing side walls or within each of the pair of opposing end walls, and a pair of bails, each bail including a straight bar abutted by two U-shaped end portions, the straight bar being parallel to the pair of opposing side walls or to the pair of opposing end walls, the U-shaped ends portions including a terminal point, the terminal point positioned within the vertical slot.

Yet another aspect of the present invention is a nestable container comprising, a bottom, four peripheral walls extending upwardly from the bottom, the four peripheral walls including a pair of opposing side walls and a pair of opposing end walls, each of the opposing side and end walls including an exterior surface and an interior surface, at least a portion of the opposing side and end walls extending outwardly from the container bottom such that the angle between the container bottom and the portion of the opposing side and end walls is obtuse, and a means for substantially limiting the shifting or slipping of container contents during transport.

Still another aspect of the present invention is a nestable container comprising a bottom, four peripheral walls extending upwardly from the bottom, the four peripheral walls including a pair of opposing side walls and a pair of opposing end walls, each of the opposing side and end walls including an exterior surface and an interior surface, at least a portion of the opposing side and outwardly from the container bottom such that the angle between the container bottom and the portion of the opposing side and end walls is obtuse, a pair of bails, and a means for limiting the ability of the container to slide along the bails of a lower stacked container when the container is stacked on top of the bails of the identical container.

Still another aspect of the present invention is a nestable container comprising a bottom, four peripheral walls extending upwardly from the bottom, the four peripheral walls including a pair of opposing side walls and a pair of opposing end walls, each of the opposing side and end walls including an exterior surface and an interior surface, at least a portion of the opposing side and end walls extending outwardly from the container bottom such that the angle between the container bottom and the portion of the opposing side and end walls is obtuse, at least one vent opening disposed within at least one of the pair of opposing side walls or the pair of opposing end walls, a pair of bails, and at least one external projection positioned along the exterior surface of at least one the pair of opposing side walls or the pair of opposing end walls, the external projections being positioned directly beneath at least one of the vent openings, the external projections having an external surface, the external surface being positioned so as not to impede the nesting of one container within another identical container.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein.

DETAILED DESCRIPTION OF THE INVENTION

Figure 1:
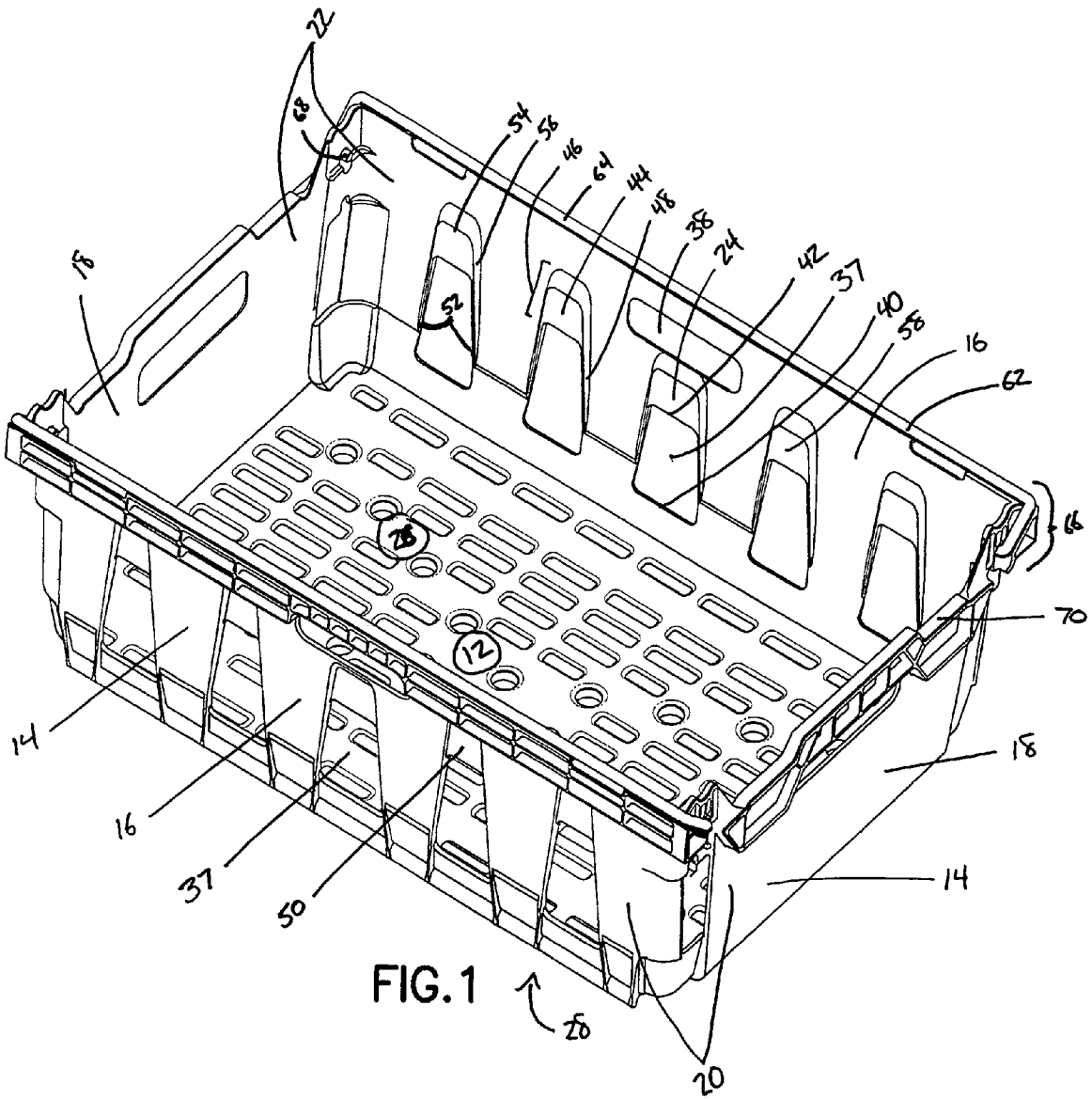
FIG. 1 is a top perspective view of a container according to one embodiment of the present invention.
Figure 2:
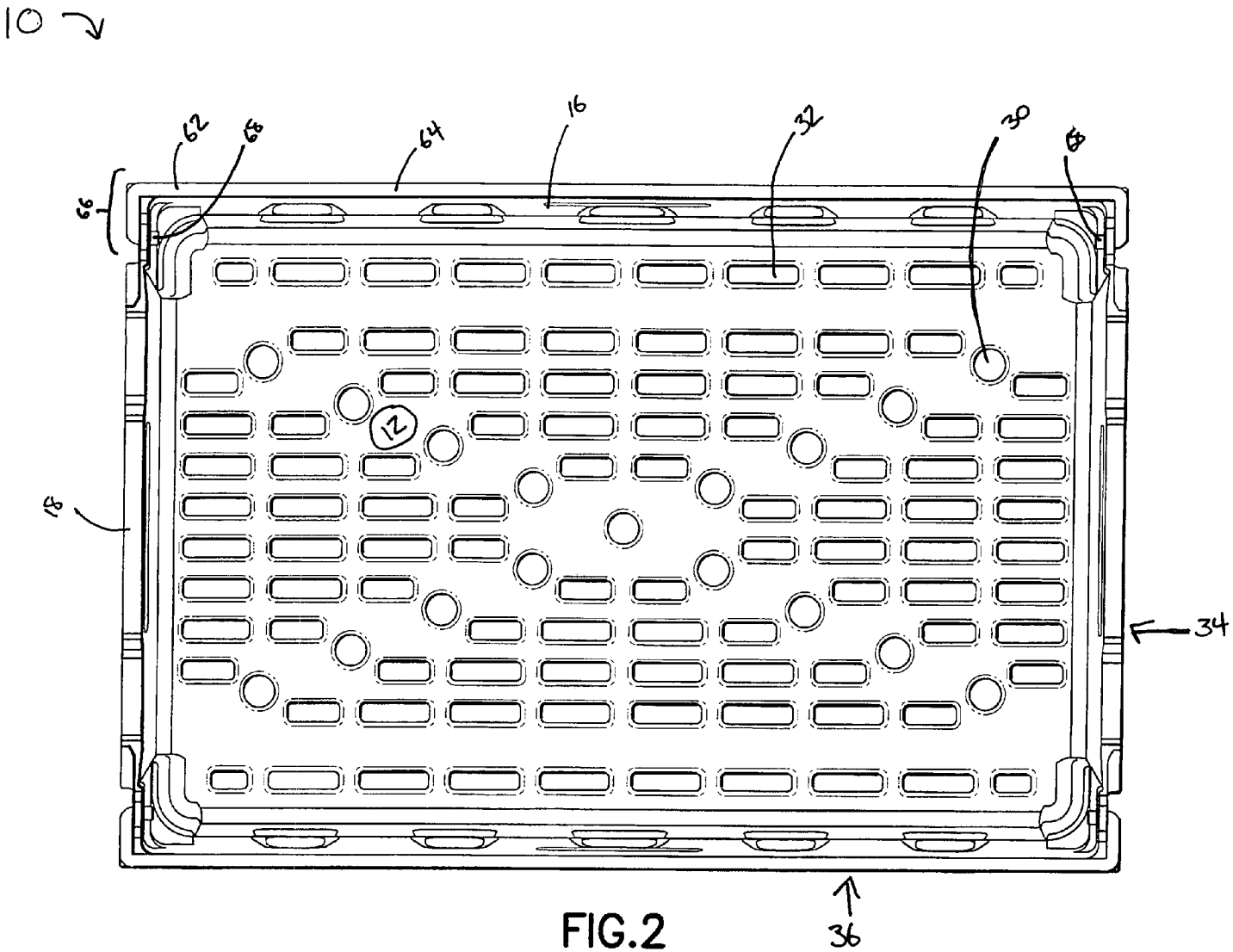
FIG. 2 is a top plan view of a container according to the embodiment of FIG. 1.
Figure 3:
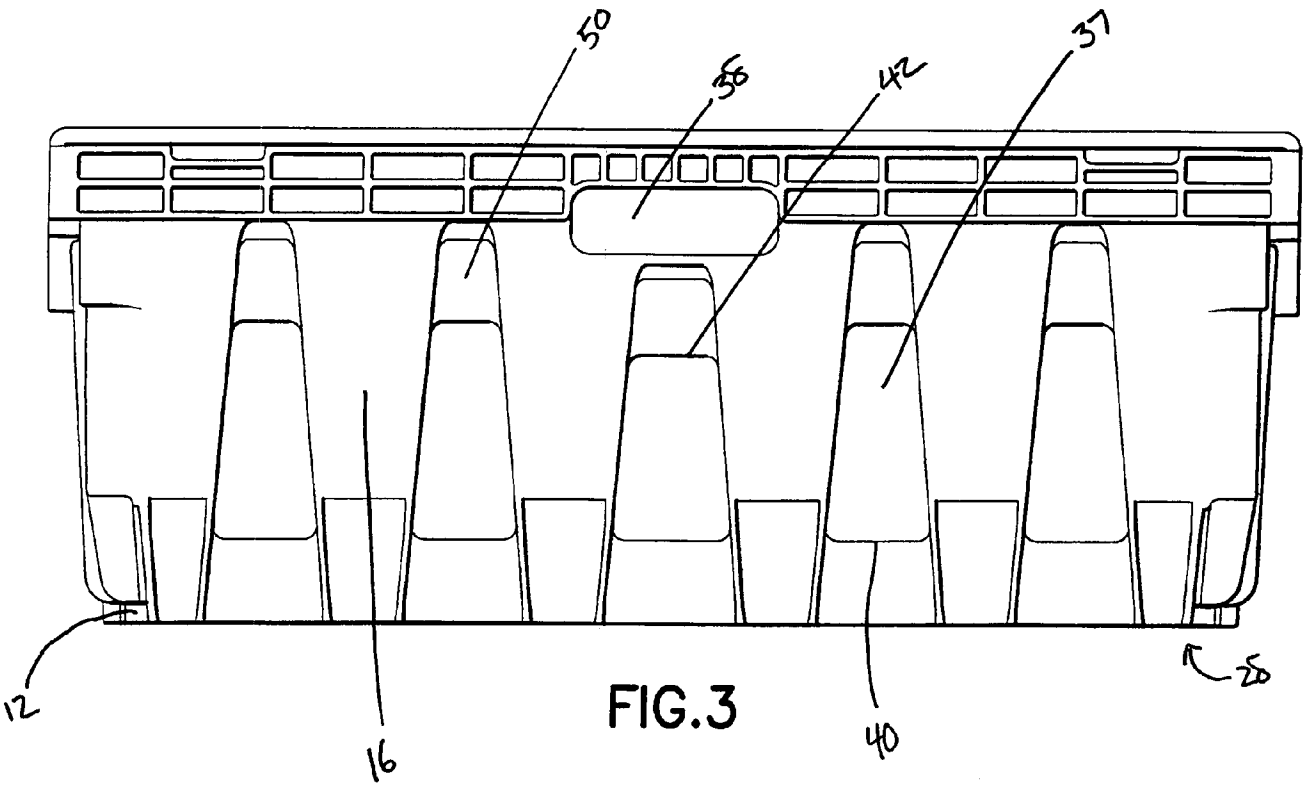
FIG. 3 is a side elevational view of a container according to the embodiment of FIG. 1.
Figure 4:
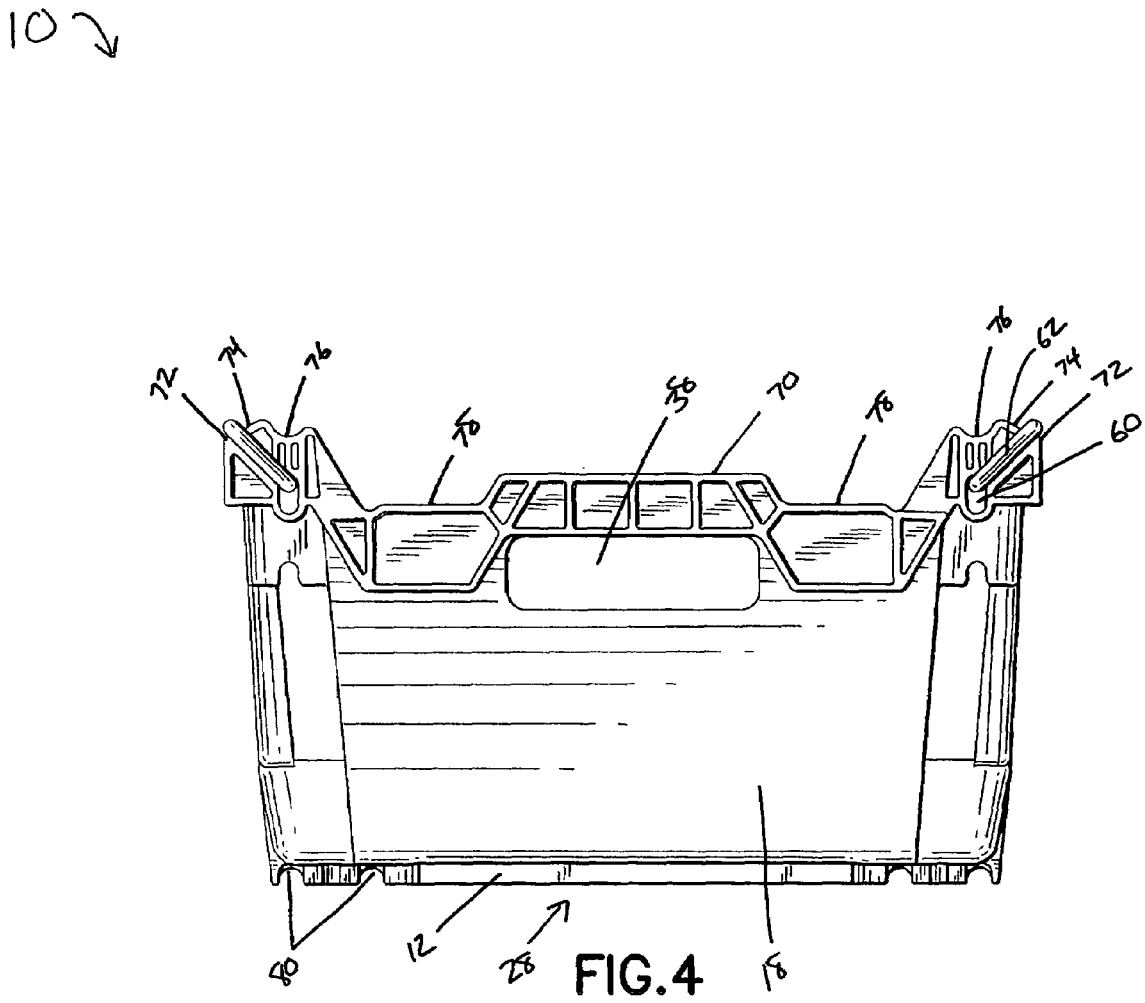
FIG. 4 is an end elevational view of a container according to the embodiment of FIG. 1.
Figure 5:
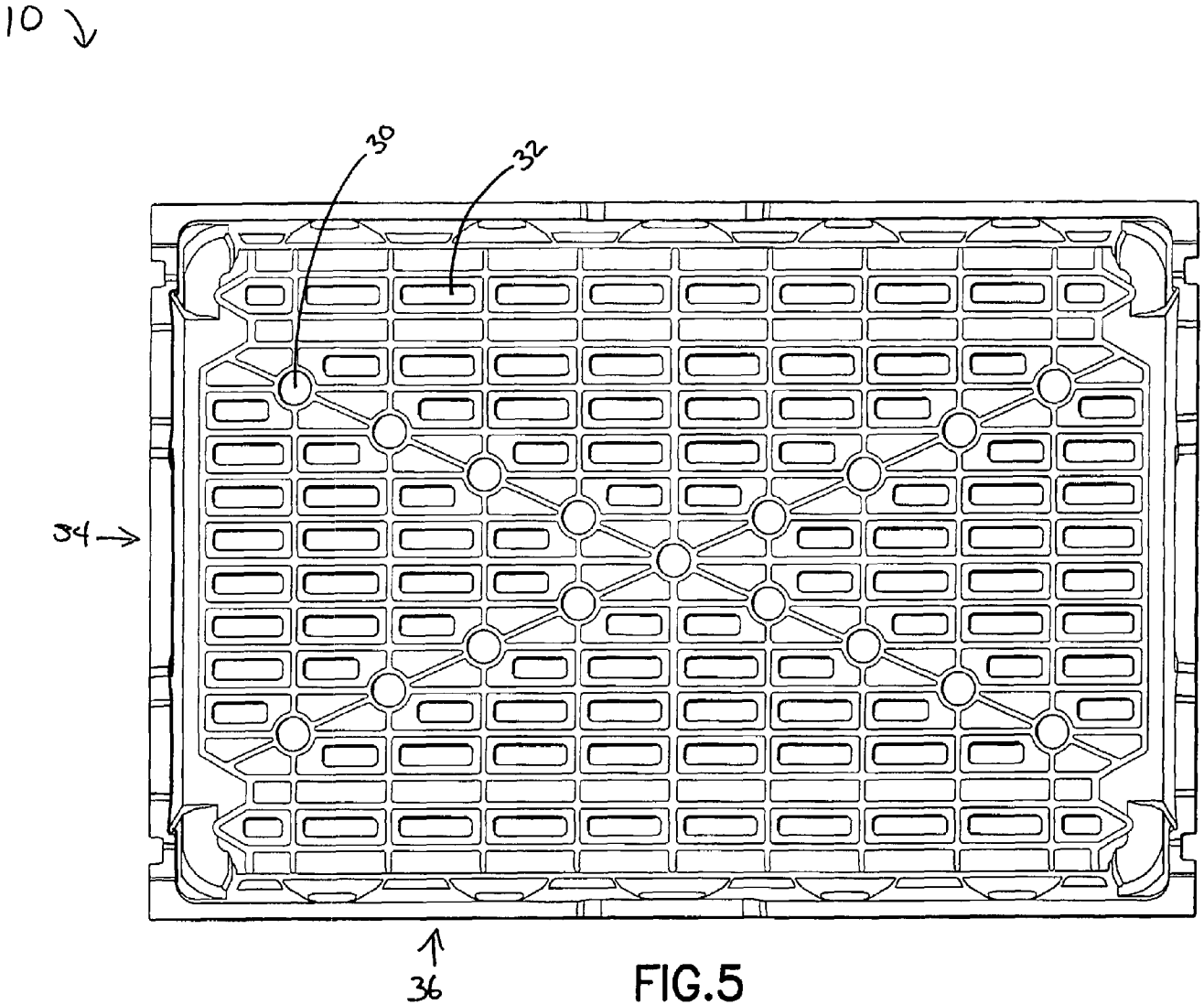
FIG. 5 is a bottom plan view of a container according to the embodiment of FIG. 1.

FIGS. 1-5 illustrate a container 10 according to the present invention. Container 10 includes a bottom 12 and four peripheral walls 14 extending upwardly and outwardly from bottom 12. The four peripheral walls 14 include a pair of opposing side walls 16 and a pair of opposing end walls 18. The side and end walls 16 and 18 have an exterior surface 20 and an interior surface 22. Interior projections 24 are positioned along interior surface 22 of either or both of opposing side walls 16 and opposing end walls 18.

Container bottom 12 includes an upper surface 26 and an underside 28. The upper surface 26 of container bottom 12 is substantially flat across the entire surface. Container bottom 12 further includes a plurality of circular drainage holes 30 and rectangular drainage holes 32. Circular drainage holes 30 form two diagonal lines across container bottom 12 resulting in an X pattern. Circular drainage holes 30 are evenly spaced along each of the two diagonal lines. Rectangular drainage holes 32 are arranged in a series of twelve rows 34 and ten columns 36 extending across container bottom 12 resulting in a grid-like pattern. Rows 34 run parallel to opposing side walls 16. Columns 36 run parallel to opposing end walls 18. Rectangular holes 30 within rows 34 and columns 36 are evenly spaced with the exception that there is a greater space between the two rows 34 adjacent side walls 16 than there is between the remaining rows 34.

Four peripheral walls 14 extend upwardly from container bottom 12. The four peripheral walls 14 include a pair of opposing side walls 16 and a pair of opposing end walls 18. Opposing side and end walls 16 and 18 include an exterior surface 20 and an interior surface 22. Opposing side and end walls 16 and 18 extend outwardly from container bottom 12 such that the angle between said container bottom 12 and each of said opposing side and end walls 16 and 18 is obtuse.

A container according to the present invention may include a series of vent openings 37 and handle cut-outs 38. In container 10, each of opposing side walls 16 includes five vent openings 37. Vent openings 37 are tapered such that they are wider at their base 40 than at their top 42. The base 40 of vent openings 37 begins slightly above crate bottom 12 such that the distance between base 40 and crate bottom 12 is approximately 1/16 of the height of opposing side walls 16. The top 42 of vent openings 37 is approximately ¾ of the way up opposing side wall 16. Vent openings 37 are equally spaced along the horizontal length of opposing side walls 16. As used herein "horizontal length" refers to the length between each of opposing end walls 18.

A container according to the present invention may include interior projections 24 positioned along the interior surface 22 of the side walls 16 or the end walls 18. Interior projections 24 may be positioned anywhere along side walls 16 or end walls 18 but are typically paired with an opening (like vent openings 37) or a depression in the exterior surface 20 of the side walls 16 or the end walls 18 such that when one container is nested with another container, interior projections 24 fit within said opening or depression. In container 10, interior projections 24 include a cap 44 bridging the uppermost portion 46 of vent openings 37, and flanges 48 extending downwardly from cap 44. Flanges 48 are adjacent to vent openings 37. Cap 44 could also be described as a depression 50 in exterior surface 20 of side wall 16. Interior projections 24 may be of varying size and shape. Alternatively, interior projections 24 could take the shape of straight ribs, a cap without flanges, or any other shape that does not impede the container's nesting function. In container 10, interior projections 24 are tapered to facilitate nesting. Interior projections 24 may be tapered in two ways. First, base 52 of interior projections 24 may be wider than the top 54 of interior projections 24. Second, sides 56 of interior projections 24 may be angled inwardly toward each other. Interior projections 24 include an interior surface 58 facing the inside of container 10. Interior surface 58 of interior projections. 24 is positioned substantially at a right angle to container bottom 12.

Container 10 further includes four vertical slots 60, two vertical slots 60 positioned within each of opposing side walls 16 or opposing end walls 18. Bails 62 including a straight bar portion 64 abutted by two U-shaped end portions 66, are positioned parallel to opposing side walls 16 or to opposing end walls 18. U-shaped end portions 66 include a terminal point 68 positioned within vertical slot 60.

In container 10, each of opposing end walls 18 includes a top surface 70. Top surface 70 includes two end points 72 each positioned at one of four corners of container 10. Top surface 70 includes an inclined portion 74 immediately adjacent to end points 72, a U-shaped notch 76 inward of and adjacent inclined portion 74, and a flat portion 78 inward of said U-shaped notch 76. Flat portion 78 is positioned beneath U-shaped notch 76 and is substantially parallel to said container bottom 12. Bails 62 are adapted to rest in fixed positions along the top surface 70 of end walls 18. Bails 62 can rest in fixed position between end points 72 and inclined portion 74, or within U-shaped notch 76, or along flat portion 78. Thus in container 10, bails 62 may rest in three fixed positions. By modification of the contours of top surface 70, bails 62 be made to rest in any number of fixed positions.

Underside 28 of container bottom 12 includes recessed saddle areas 80 for receiving bails 62 when container 10 is stacked on top of the bails of a lower-stacked identical container.

Figure 6:
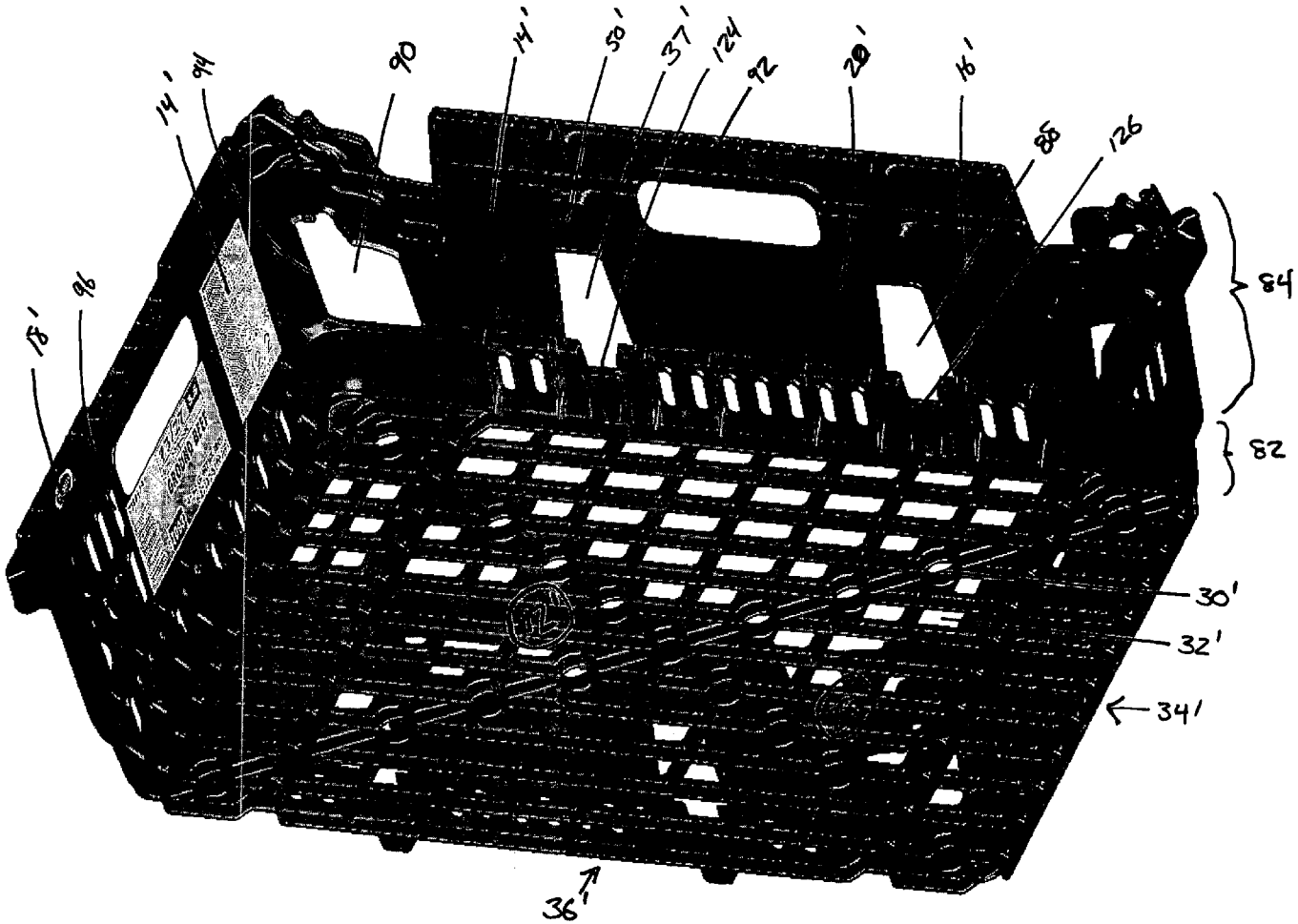
FIG. 6 is a bottom perspective view of a container according to another embodiment of the present invention.
Figure 7:
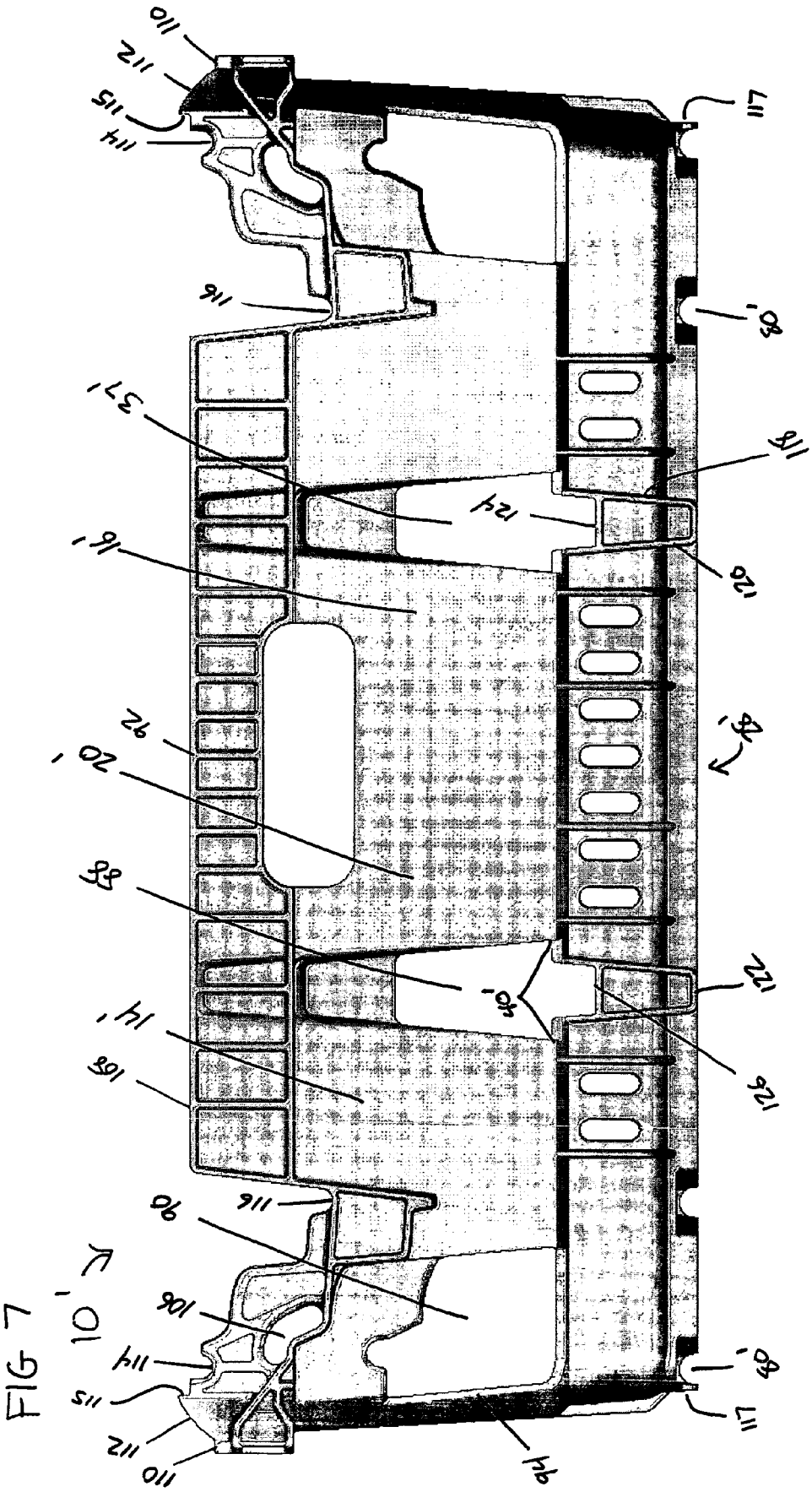
FIG. 7 is a side elevational view of a container according to the embodiment of FIG. 6.
Figure 8:
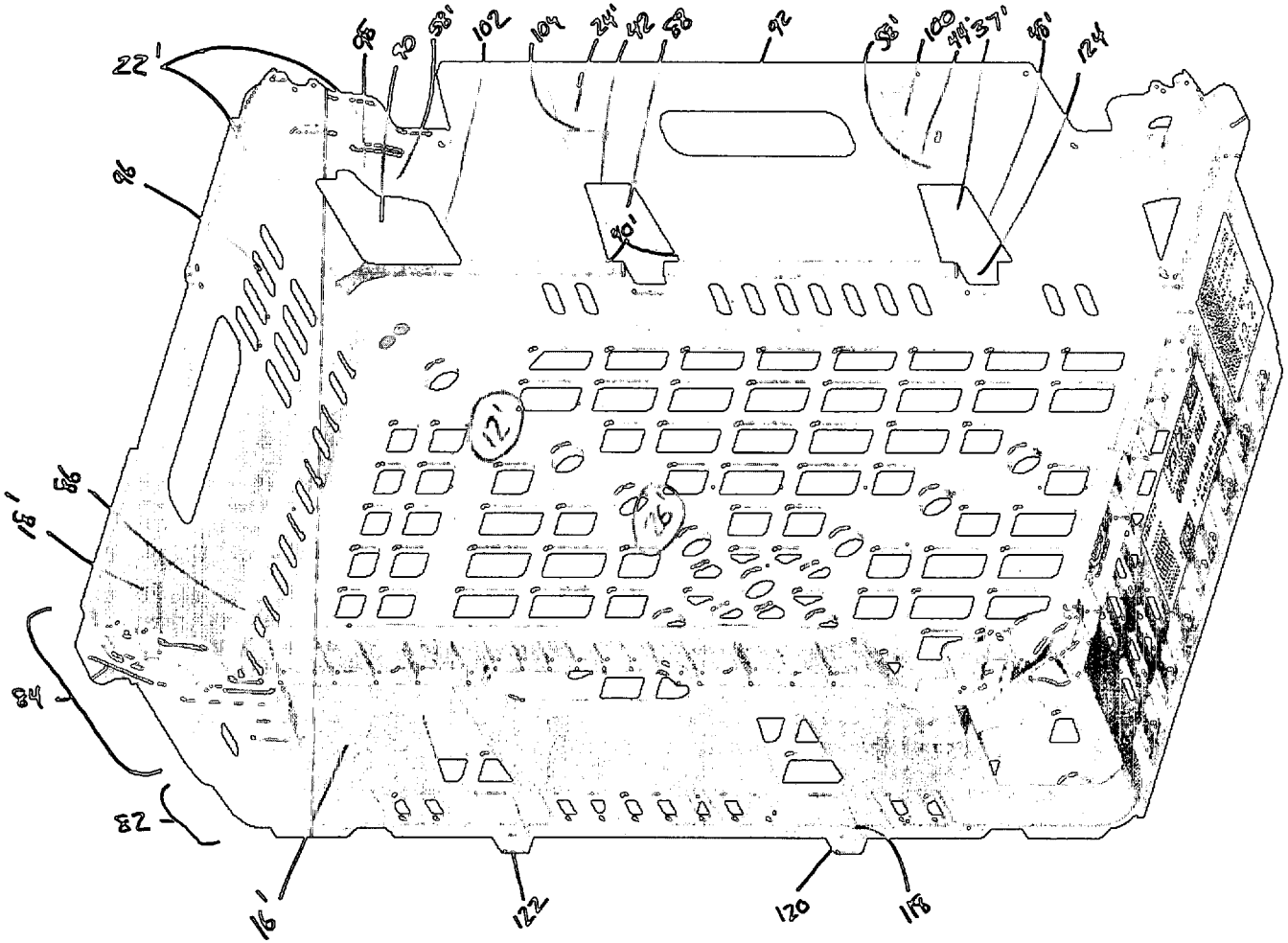
FIG. 8 is a top perspective view of a container according to the embodiment of FIG. 6.
Figure 9:
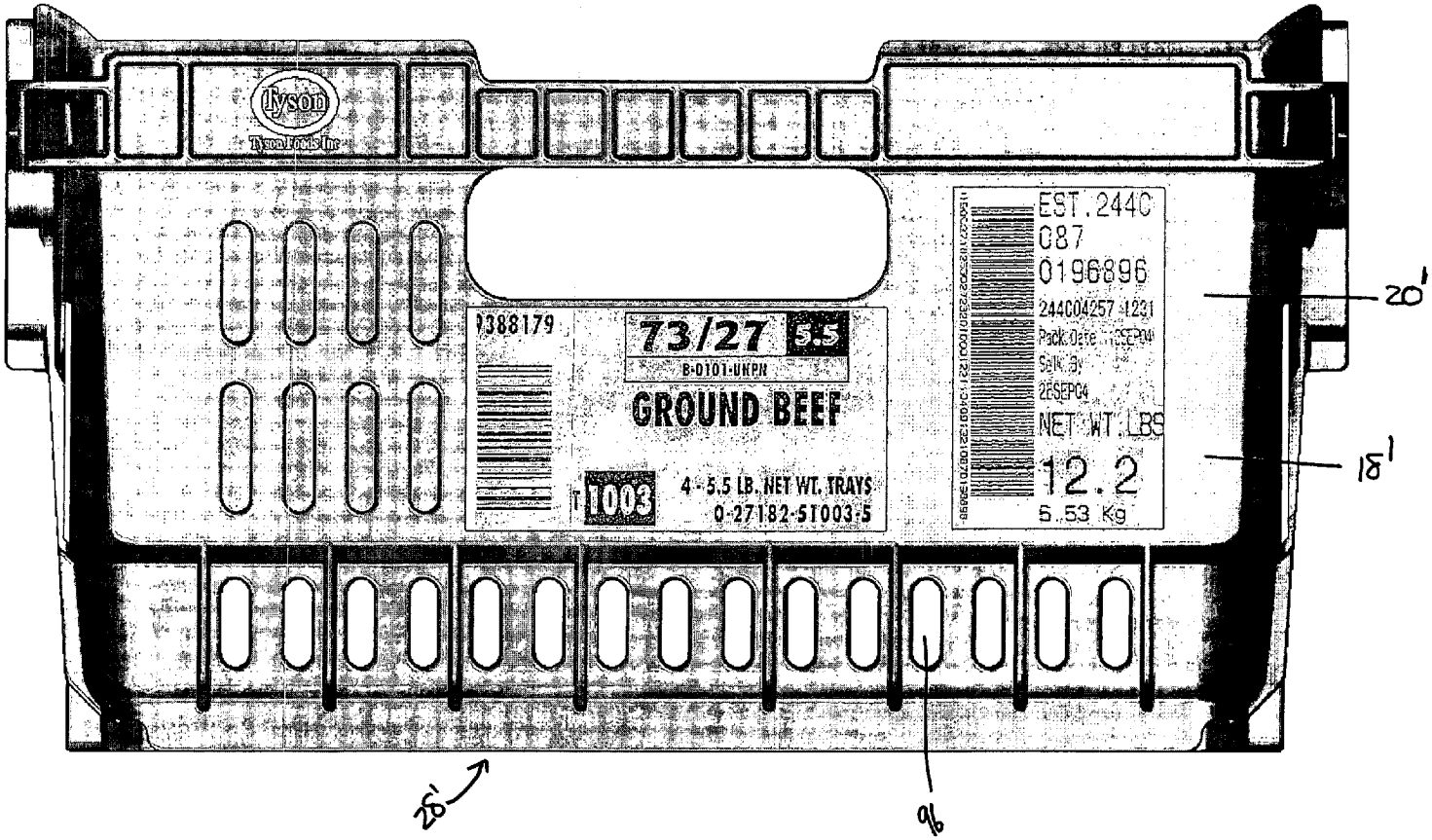
FIG. 9 is an end elevational view of a container according to the embodiment of FIG. 6.
Figure 10:
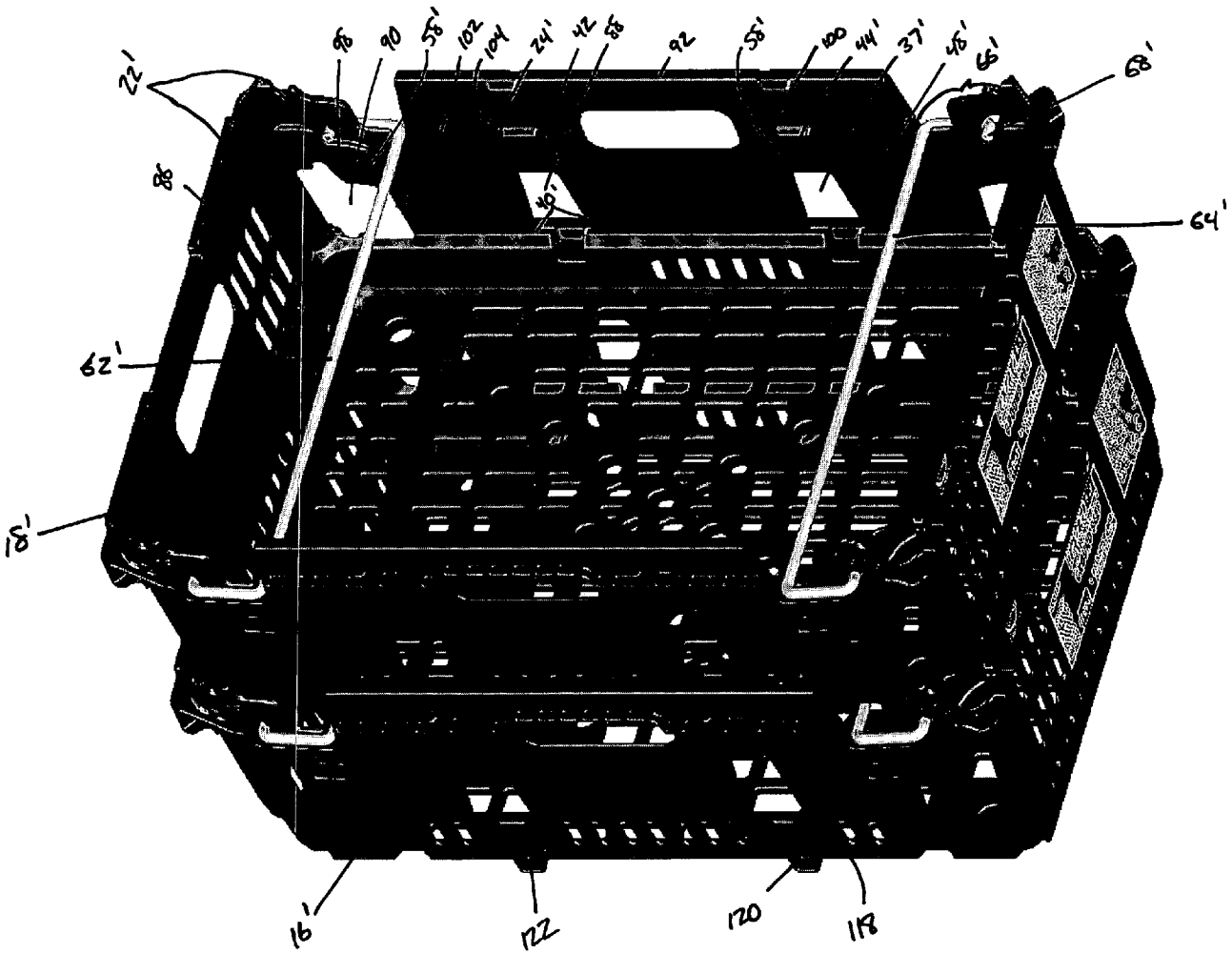
FIG. 10 depicts a container according to the embodiment of FIG. 6 stacked on top of the bails of an identical container.

FIGS. 6-9 depict container 10', another embodiment of the present invention. container 10' shares many of the same features as the above described container 10. As shown in FIGS. 6 and 8, container 10' includes a bottom 12' and four peripheral walls 14' extending upwardly and outwardly from bottom 12'. The four peripheral walls 14' include a pair of opposing side walls 16' and a pair of opposing end walls 18'. The side and end walls 16' and 18' have an exterior surface 20' and an interior surface 22'. Interior projections 24' are positioned along interior surface 22' of either opposing side walls 16' or opposing end walls 18'.

Container bottom 12' includes an upper surface 26' and an underside 28'. The upper surface 26' of container bottom 12' is substantially flat across the entire surface. Container bottom 12' includes a plurality of circular drainage holes 30' and rectangular drainage holes 32'. Circular drainage holes 30' form two diagonal lines across container bottom 12' resulting in an X pattern. Rectangular holes 32' are arranged in a series of rows 34' and columns 36' extending across container bottom 12' resulting in a grid-like pattern. Rows 34' run parallel to opposing side walls 16'. Columns 36' run parallel to opposing end walls 18'.

Still referring to FIGS. 6-9, four peripheral walls 14' extend upwardly from container bottom 12'. The four peripheral walls 14' include a pair of opposing side walls 16' and a pair of opposing end walls 18'. Opposing side and end walls 16' and 18' include an exterior surface 20' and an interior surface 22'. Opposing side and end walls 16' and 18' further include a lower base portion 82 and an upper portion 84.

Lower base portion 82 of opposing side and end walls 16' and 18' may be positioned at varying angles with respect to container bottom 12'. In container 10' lower base portion 82 is positioned at an angle of approximately 95° with respect to container bottom 12'. Lower base portion 82 is approximately ¼ of the total height of opposing side and end walls 16 and 18. Upper portion 84 of opposing side and end walls 16' and 18' extends outwardly from container bottom 12' such that the angle between said container bottom 12' and upper portion 84 of said opposing side and end walls 16' and 18' is obtuse. Upper portion 84 may be positioned at varying obtuse angles with respect to container bottom 12'. In container 10', upper portion 84 is more obtuse (i.e., further from perpendicular) than lower base portion 82. A beveled ledge 86 is formed where lower base portion 82 joins with upper portion 84. Beveled ledge 86 may be positioned at varying angles. In container 10' beveled ledge 86 is positioned at approximately a 45 degree angle with respect to lower base portion 82.

Side walls 16' and end walls 18' may include a series of vent openings 37' and a handle cut-out 38' Vent openings 37' may include mid-vent openings 88 and end-vent openings 90. In container 10', mid-vent openings 88 are tapered such that they are wider at their base 40' than at their top 42'. The base 40' of mid-vent openings 88 can be positioned any height above container bottom 12'. In container 10', the base 40' of mid-vent openings 88 begins above crate bottom 12' such that the distance between base 40' and crate bottom 12' is approximately ⅛ of the height of opposing side walls 16'. The top 42' of mid-vent openings 88 may be positioned at any height. In container 10' top 42' is approximately ⅔ of the way up opposing side wall 16'. Mid-vent openings 88 may be positioned anywhere along side walls 16' and end walls 18'. In container 10', mid-vent openings 88 are equally spaced along side wall 16' such that each mid-vent openings 88 is the same distance from the closest end wall 18' and the same distance from mid-point 92 of side wall 16'. End-vent-openings 88 may be of varying size and shape. In container 10' end-vent openings 88 have an irregular shape and abut end walls 18. End-vent openings 90 include angled vent-side 94. Angled vent-side 94 is outwardly angled.

End walls 18' include a series of small vent openings 96.

Upper portion 84 includes interior projections 24' positioned along the interior surface 22' of the side walls 16' or the end walls 18'. As discussed above with respect to container 10, interior projections 24' can be positioned anywhere along side walls 16' or end walls 18' and can be of varying size and shape. Interior projections 24 are typically paired with an opening (like vent openings 37') or a depression (like depression 50') in the exterior surface 20' of the side walls 16' or the end walls 18' such that when one container is nested with another container, interior projections 24' fit within said opening or depression.

Container 10' includes four interior projections 24' on each of the side walls 16'. These four interior projections 24' include two end-projections 98 positioned at opposing ends of side walls 16' and two mid-projections 100 positioned between end-projections 98. End-projections 98 have an asymmetric barbell-like shape and are positioned abutting end walls 18' and directly above end-vent-openings 90. End-projections 98 include a flange 102 extending downwardly from one side of end-projections 98. Flange 102 is adjacent to end-vent-openings 86. Mid-projections 100 are equally spaced along side wall 16' such that each mid-projection 100 is the same distance from the closest end wall 18' and the same distance from the midpoint 92 of side wall 16'. Mid-projections 100 in container 10' have much the same shape as interior projections 24 in container 10. Mid-projections 100 include a cap 44' bridging the uppermost portion 46' of vent openings 36' and flanges 48' extending downwardly from cap 44.' Flanges 48' are adjacent to vent openings 37.' Cap 44' could also be described as a depression 50' in exterior surface 20' of side wall 16.' Mid-projections 100 differ from the projections described with respect to container 10 principally in that the include a groove 104 bisecting cap 44' and that cap 44' is proportionally taller in container 10' than in container 10.

Interior projections 24' including both end-projections 98 and mid-projections 100 include an interior surface 58' facing the inside of container 10'. Interior surface 58' of interior projections 24' is positioned substantially at a right angle to container bottom 12'.

Still referring to FIGS. 6-9, container 10' may include a pair of bails. Bails may be as described with respect to container 10, or they can be configured in an alternate manner. In container 10', bails 62' are much as previously described and include a straight bar portion 64' abutted by two U-shaped end portions 66'. U-shaped end portions 66' include a terminal point The bails of container 10' differ from those in container 10 in that terminal point 68 is positioned within arced slot 106 rather than a vertical slot. Container 10' further differs in that bails 62' run parallel to end walls 18' rather than side walls 16'.

In container 10', each of opposing side walls 16' includes a top surface 108. Top surface 108 of side walls 16' includes two end points 110 each positioned at a corner of container 10'. Top surface 108 includes an inclined portion 112 immediately adjacent to end points 110, a first U-shaped notch 114 inward of and adjacent inclined portion 108, and a second U-shaped notch 116 inward of first U-shaped notch 114. Second U-shaped notch 116 is positioned beneath first U-shaped notch 114. Bails 62' are adapted to rest in three fixed positions along the top surface 108 of side walls 16'. Bails can rest in fixed position between end points 110 and inclined portion 112, within first U-shaped notch 114, or within second U-shaped notch 116. As discussed previously with respect to container 10, top surface 108 may be alternately configured to accommodate fewer or more fixed resting positions. Top surface 108 further includes upper vertical portion 115.

Underside 28' of container bottom 12' includes recessed saddle areas 80' for receiving bails 62' when container 10' is stacked on top of the bails of a lower-stacked identical container. Underside 28' further includes lower vertical portion 117. Lower vertical portion 117 is disposed slightly inward of upper vertical portion 115. Still referring to FIGS. 6-9, external projections 118 may be positioned along the exterior surface 20' of opposing side walls 16' or opposing end walls 18'. External projections 118 can be of varying size, shape, and position. In container 10' external projections 118 are positioned beneath vent openings 37' and beneath mid-projections 100 on the exterior surface 20' of side walls 16'. Three ribs join together to give external projections 118 a substantially U-shaped appearance. External projections 118 include an external surface 120 and a base 122. External surface 120 is the outward facing surface of external projection 118. External surface 120 is positioned inward of interior surface 58'.

When container 10' is stacked upon bails 62' of an identical container, external projections 118 align with mid-projections 100. Because external surface 120 of external projection 118 is positioned inward of interior surface 58' of mid-projection 100, external projection 118 does not impede the stacking of container 10' on top of the bails 62' of an identical container. When container 10' is stacked upon bails 62' of an identical container, there is a small amount of clearance between external surface 120 of external projection 118 and interior surface 58' of mid-projection 100.

Container 10' further includes a notch 124 within lower base portion 82 of opposing side walls 16'. Notch 124 includes a base 126. When container 10' is nested within an identical container, base 122 of external projection 118 rests upon base 126 of notch 124 controlling the nesting depth of container 10'.

In use, the features of containers 10 and 10' confer substantial advantages. Interior projections 24 and 24' offer an advantage over prior art containers by giving the containers the advantages of both a perpendicular wall crate and a nestable crate without the drawbacks of a collapsible crate. By presenting a surface substantially perpendicular to crate bottom 12 and 12', interior surface 58 and 58' of interior projections 24 and 24' substantially limits the shifting or slipping of container contents during transport. And, because interior projections 24 and 24' are positioned on outwardly angled side or end walls, the containers remain nestable, reducing the amount of space required to store empty containers. Interior projections 24 and 24' also present a simple, easily cleaned structure, in contrast to the intricate bacteria-collecting structure of a prior art collapsible container.

The provision of bails 62 and 62', allows containers 10 and 10' to be stacked on top of one another when loaded without damaging the contents of the containers. In container 10, the combination of top surface 70 of end walls 18, including inclined portion 74, U-shaped notch 76, and flat portion 78 with pivoting bail 62 enables three separate stacking positions. Similarly, in container 10', the combination of top surface 108 of side walls 16', including inclined portion 112, first U-shaped notch 114, and second U-shaped notch 116 with pivoting bail 62' also enable three separate stacking positions. Running bails 62' parallel to the shorter end walls 18' of container 10' provides greater bail-strength than would running bails 62' parallel to side walls 16'.

External projections 118 offer advantages over the prior art because they improve the stability of a stack of containers when one container is stacked on top of the bails of an identical container. Because the sides of nestable containers are outwardly angled, the footprint of the container bottom is smaller than is the footprint of the top of the crate. The bails, which are positioned along the top of the crate, are wider than is the portion of the container bottom which rests on the bails. As a result, an upper-stacked container can slide along the bails of a lower stacked crate. If multiple upper-stacked crates are free to slide to a non-centered position, a stack of crates may become unstable. External projections 118 limit the ability of a container to slide along the bails of a lower stacked container by effectively expanding the footprint of the base of the container. Container 10' is free to slide along the bails of a below stacked container only to the extent of the clearance between external projections 118 and interior projections 24'. One can control the extent to which a container can slide along the bails of another container by modifying the amount of clearance between external projections 118 and interior projections 24'.

Recessed saddle areas 80 and 80' in undersides 26 and 26' of container bottoms 12 and 12' further improve stacking stability by preventing containers 10 and 10' from sliding in a direction perpendicular to the length of bails 62 and 62' when containers 10 and 10' are stacked on top of the bails of an identical container. The interaction of upper vertical portion 115 with lower vertical portion 117 helps align containers for stacking when container 10' is stacked on the bails of an identical lower container.

Vertical slots 60 offer advantages over the prior art in helping to fix bails firmly in position. Typically bails shift from inward position to outward position by pivoting within an arced or circular opening. Such an opening may not firmly fix bails in position and may allow bail movement in a direction normal to the length of the bail. Vertical slots 60 help to limit bail movement at the pivot point of the bail.

Vent openings 37 and 37' allow for air circulation and fluid drainage and provide an area within which interior projections 24 and 24' can fit when containers 10 and 10' are nested within an identical container. Depressions 50 and 50' in exterior surface 22 and 22' similarly provides an area within which interior projections 24 and 24' can fit when containers 10 and 10' are nested within an identical container. Angled vent-side 94 of end-vent 88 provides clearance so that end-projection 118 can fit within end-vent 88 when container 10' is nested within an identical container.

Beveled ledge 86 helps to align and position trays within container 10' such that trays can rest on container bottom 12'.

Circular drainage holes 30 and 30' and rectangular drainage holes 32 and 23' allow for fluid drainage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nestable container comprising:

a bottom;

four peripheral walls extending upwardly from said bottom, said four peripheral walls including a pair of opposing side walls and a pair of opposing end walls, each of said opposing side and end walls including an exterior surface and an interior surface, at least a portion of each of said opposing side and end walls extending outwardly from said container bottom such that the angle between said container bottom and said portion of said opposing side and end walls is obtuse;

interior projections positioned along said interior surface of at least one of said pair of opposing side walls or said pair of opposing end walls, each of said interior projections having an interior surface, said interior surface of each of said interior projections positioned substantially at a right angle to a plane of said bottom;

a pair of bails; and external projections positioned along said exterior surface of at least one of said pair of opposing side walls or said pair of opposing end walls, each of said external projections having an external surface, said external surface of each of said external projections being positioned slightly inward of said interior surface of each of said interior projections, at least a portion of said external projections aligning with said interior projections when said container is stacked on said bails of an identical container.

2. A container according to claim 1, further comprising:

a means for limiting the ability of said container to slide along bails of a lower stacked container when said container is stacked on top of said bails of said lower stacked container.

3. A container according to claim 1, wherein said interior projections are tapered to facilitate nesting.

4. A container according to claim 1, wherein at least one of said pair of opposing side walls or said pair of opposing end walls includes vent openings, and wherein at least a portion of said interior projections is positioned adjacent to said vent openings.

5. A container according to claim 1, wherein at least one of said pair of opposing side walls or said pair of opposing end walls includes vent openings, said vent openings including a topmost portion, a portion of said interior projections bridging said topmost portion of said vent openings.

6. A container according to claim 1, further comprising four vertical slots, two of said vertical slots positioned within each of said pair of opposing side walls or within each of said pair of opposing end walls; and wherein each of the pair of bails includes a straight bar abutted by two U-shaped end portions, each said straight bar being parallel to said pair of opposing side walls or to said pair of opposing end walls, each of said U-shaped end portions including a terminal point, each said terminal point positioned within a respective one of said vertical slots.

7. A container according to claim 6, wherein each of said pair of opposing end walls includes a top surface, each said top surface including two end points, each end point positioned at one of four corners of said container, each said top surface including an inclined portion immediately adjacent to said end points, a U-shaped notch inward of and adjacent said inclined portion, and a flat portion inward of said U-shaped notch, said flat portion positioned beneath said U-shaped notch, said flat portion being substantially parallel to said container bottom.

8. A container according to claim 1, further comprising a means for stacking said container on top of an identical container without damaging the contents of said identical container.

9. A nestable container according to claim 1, further comprising:

a means for substantially limiting the shifting or slipping of container contents during transport.

10. A container according to claim 9, further comprising:

four vertical slots, two of said vertical slots positioned within each of said pair of opposing side walls or within each of said pair of opposing end walls;

wherein each of the pair of bails includes a straight bar abutted by two U-shaped end portions, each said straight bar being parallel to said pair of opposing side walls or to said pair of opposing end walls, each of said U-shaped ends portions including a terminal point, each said terminal point positioned within a respective one of said vertical slots.

11. A container according to claim 10, wherein each of said pair of opposing end walls includes a top surface, each said top surface including two end points, each end point positioned at one of four corners of said container, each said top surface including an inclined portion immediately adjacent to said end points, a U-shaped notch inward of and adjacent said inclined portion, and a flat portion inward of said U-shaped notch, said flat portion positioned beneath said U-shaped notch, said flat portion being substantially parallel to said container bottom.

12. A container according to claim 9, further comprising a means for stacking said container on top of an identical below-stacked container without damaging the contents of the lower-stacked container.

13. A container according to claim 9, further comprising:

at least one vent opening disposed within at least one of said pair of opposing side walls or said pair of opposing end walls;

wherein each of said external projections is positioned beneath a respective one of said vent openings, and each said external surface of each of said external projections is positioned so as not to impede the nesting of one container within another identical container.

14. A container according to claim 9, further comprising:

a means for limiting the ability of said container to slide along hails of a lower stacked container when said container is stacked on top of said bails of said lower stacked container.

* * * * *